United States Patent [19]

Yasumi

[11] Patent Number: 4,787,545

[45] Date of Patent: Nov. 29, 1988

[54] PAPER FEEDING MECHANISM

[75] Inventor: Yoshiyuki Yasumi, Tamayama, Japan

[73] Assignee: Alps Electric Co., Ltd., Tokyo, Japan

[21] Appl. No.: 85,533

[22] Filed: Aug. 14, 1987

[30] Foreign Application Priority Data

Oct. 20, 1986 [JP] Japan ..... 61-160578[U]

[51] Int. Cl.[4] ..... B65H 20/20; B41J 11/30

[52] U.S. Cl. ..... 226/74; 400/616.2

[58] Field of Search ..... 226/74, 75, 170; 400/616, 616.1, 616.2; 74/354, 384

[56] References Cited

U.S. PATENT DOCUMENTS 4,214,691 7/1980 Van Namen ..... 226/74

4,662,767 5/1987 Pimintel ..... 400/616.2

*Primary Examiner*—David Werner

*Attorney, Agent, or Firm*—Guy W. Shoup; Paul J. Winters

[57] ABSTRACT

A paper feeding mechanism wherein tractors which convey a sheet of paper by means of belts when a driven shaft connected to a drive gear is rotated are supported swingable round a support shaft to move from their closed position to their open position and vice versa, characterized by a stopper member having those teeth which are selectively engaged with the drive gear to stop the rotation of the drive gear, and by a drive member for driving the stopper member to engage its teeth with the drive gear only when the tractors are under their open position. The free running of the belts can be this prevented when the tractors are under their open state, thereby allowing the sheet of paper to be stably mounted.

4 Claims, 3 Drawing Sheets

PAPER FEEDING MECHANISM

BACKGROUND OF THE INVENTION (a) Field of the Invention

The present invention relates to a paper feeding mechanism for use with the printer and more particularly, it relates to a paper feeding mechanism capable of opening and closing those tractors through which a sheet of paper is conveyed.

(b) Prior Art

FIGS. 3(A) and 3(B) show one of the conventional paper feeding mechanisms. Driven and support shafts 2 and 3 supported by both side plates of the printer are arranged adjacent and horizontal to a platen 1 of the printer and also parallel to the axial direction of the platen 1 in such a way that the driven shaft 2 is centrally positioned between the platen 1 and the support shaft 3. The driven shaft 2 is driven and rotated by a drive gear (not shown) and swung clockwise by about 100 degrees round the support shaft 3 from the closed state shown in FIG. 3(B) to the opened state shown in FIG. 3(A).

A pair of tractors 4 which are engaged with holes (not shown) on both sides of a sheet of paper S to convey the paper S are supported on the driven and support shafts 2 and 3. Each of the tractors 4 has a drive pulley 5 fitted onto the driven shaft 2, a follower pulley 6 fitted onto the support shaft 3, and a belt 7 stretched between the drive and follower pulleys 5 and 6. Plural pins 8 which have same pitch as that of the paper feeding holes are projected from the outer circumferential face of the belt 7. A pair of paper holder members 9A and 9B which are separated in the vertical direction are swingably supported by the frame (not shown).

When the paper S is to be mounted on the tractors 4, each of the tractors 4 is swung round the support shaft 3 to move from its closed position to its opened position shown in FIG. 3(A). When the paper S stacked is pulled out and its foremost end reaches near the lower paper holder members 9B, as shown in FIG. 3(A), the paper holder members 9B are swung open, allowing the pins 8 on the belts 7 to be fitted into the holes on both sides of the paper S. The paper holder members 9B are then again swung close and, holding the paper S fitted on the belts 7, the tractors 4 are swung anti-clockwise round the support shaft 3 to move from their state shown in FIG. 3(A) to their closed state. The driven shaft 2 is then driven and rotated to feed the paper S. When the paper S passes round the platen 1 and again reaches the tractors 4, the upper paper holder members 9A are swung open, allowing the holes on both sides of the paper S to be fitted onto the pins 8 on the belts 7, and then again swung close. The mounting of the paper S is thus completed, as shown in FIG. 3(B).

In the case of the above-described conventional paper feeding mechanism, however, the drive gear (not shown) which drove and rotated the driven shaft 2 was released from a transmission gear (not shown) which transmitted the drive of a drive source to the drive gear and the follower pulley 6 fitted onto the support shaft 3 was left freely rotatable, when the tractors 4 were under their open state, as shown in FIG. 3(A). The belts 7 were thus allowed to freely run when the tractors 4 were under their open state, thereby making it difficult to fit the holes of the paper S onto the pins of the belts 7. The mounting of the paper S was thus made troublesome and unstable.

SUMMARY OF THE INVENTION

The present invention is therefore intended to eliminate the above-mentioned drawback.

The object of the present invention is therefore to provide a paper feeding mechanism capable of stopping the free running of the belts, when the tractors are positioned open, so as to make the mounting of the paper easy and stable.

According to the present invention, there can be provided a paper feeding mechanism wherein tractors which convey a sheet of paper by means of belts when a driven shaft connected to a drive gear is rotated are supported swingable round a support shaft to move from their close position to their open position and vice versa, characterized by a stopper member having those teeth which are selectively engaged with the drive gear to stop the rotation of the drive gear, and by a drive member for driving the stopper member to engage its teeth with the drive gear only when the tractors are under their open position.

According to the present invention, the stopper member can be driven by the drive member to engage its teeth with the drive gear when the tractors are under their open state. The rotation of the drive gear can be thus stopped by the stopper member, thereby making the mounting of the paper stable and reliable.

DETAILED DESCRIPTION OF THE PREFERRED EMBODIMENT

An embodiment of the present invention will be described referring to the accompanying drawings.

Figure 1:
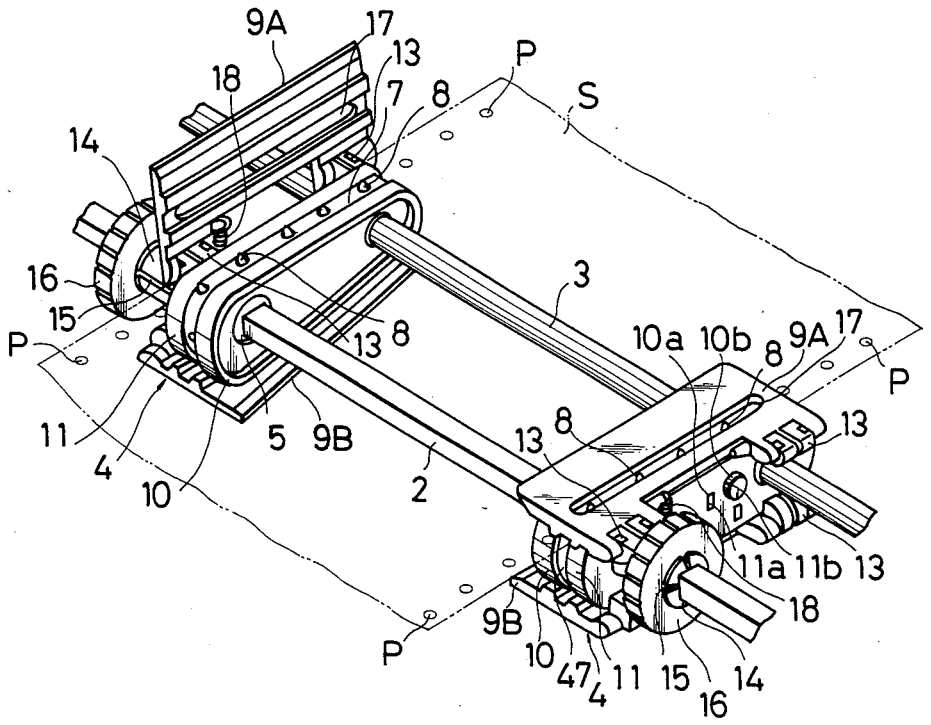
FIG. 1 is a perspective view showing an example of the paper feeding mechanism according to the present invention.

FIG. 1 shows a practical paper feeding section of a paper feeding mechanism according to the present invention. A pair of tractors 4 are slidably supported on a driven shaft 2, square in section, and a support shaft 3. Each of the tractors 4 has first and second frames 10 and 11, and when an engaging piece **10*a* extending from the first frame 10 and having a pawl at the front end thereof and an auxiliary pin 10*b* also extending from the first frame 10 are inserted into a rectangular opening 11*a* and a circular opening 11*b*, respectively, both of the frames 10 and 11 are combined integral to form an outer wall of the tractor 4. The second frame 11 is further provided with pieces 13 to which paper holder members 9A and 9B** are attached.

A lock sleeve 14 is fitted onto the driven shaft 2 outside each of drive pulleys 5. The lock sleeve 14 has four radially-directed slits 15, each separated from one another in the circumferential direction of the lock sleeve 14, and the inner circumferential face of the lock sleeve 14 has same square section as that of the driven shaft 2 while the outer circumferential face thereof is made substantially circular in section. The lock sleeve 14 is further provided with projections (not shown) to hold a lock member 16, which is a substantially circular ring and the inner circum-ferential face of the lock member 16 is made same circular in section as the outer circumferential face of the lock sleeve 14.

A belt 7 is stretched between a follower pulley 6 and the drive pulley 5 and it runs along the outer circumference of the tractor 4 according to the rotation of the driven shaft 2. It has on its outer circumference and along its running direction a plurality of pins 8 which have same pitch as that of paper-feeding holes P provided on both sides of a sheet of paper S.

The paper holder members 9A and 9B are supported, swingable up and down, on and under the tractor 4 by means of the attachment pieces 13 of the second frame 11. Each of the paper holder members 9A and 9B is provided with a slit 17 for leaving the pins 8 free when it is closed to hold the paper S, and it is also provided with a spring 8 to urge it toward its closed position.

Figure 2A:
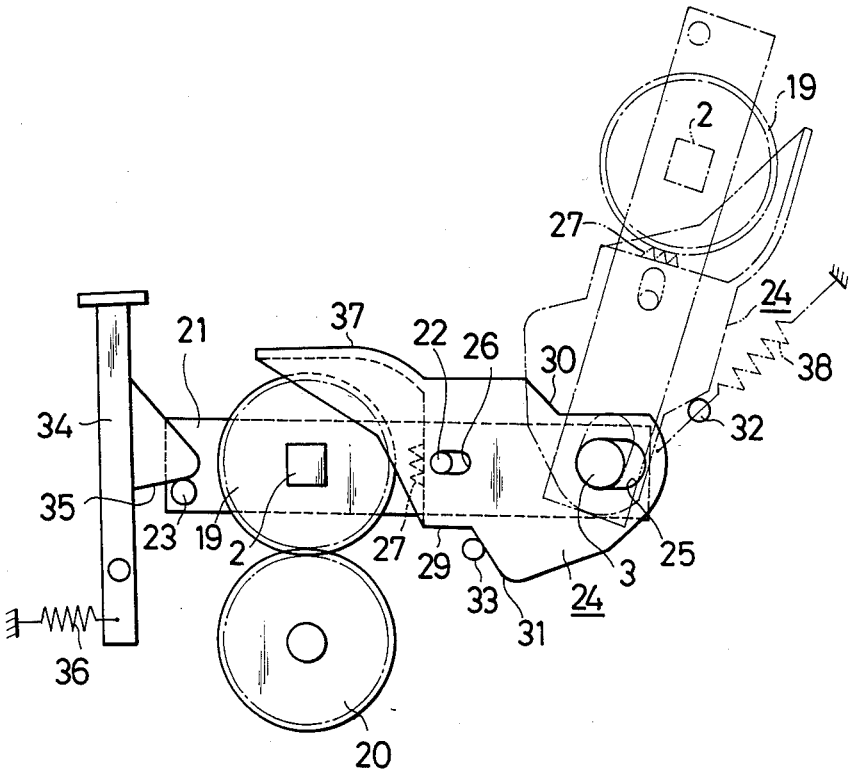
FIGS. 2(A) and 2(B) are side and plan views showing main portions of the paper feeding mechanism according to the present invention.
Figure 2B:
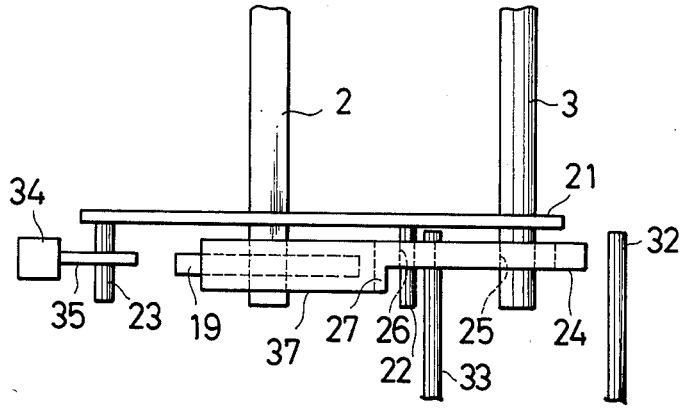
Figure 3A:
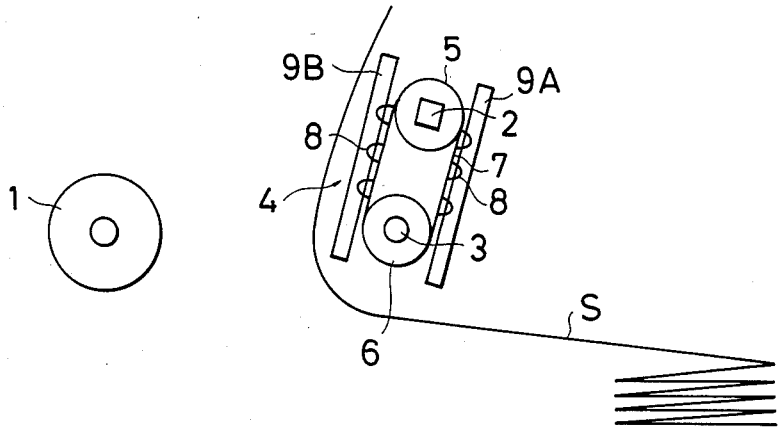
FIG. 3A PRIOR ART
FIGS. 3(A) and 3(B) are side views roughly showing the operation of the conventional paper feeding mechanism.
Figure 3B:
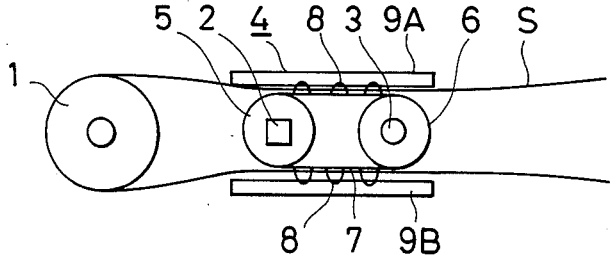
FIG. 3B PRIOR ART

As shown in FIGS. 2(A) and 2(B), an end of the driven shaft 2 which is not shown in FIG. 1 is provided with a drive gear 19 to drive and rotate the driven shaft 2 and the drive gear 19 is engaged with a transmission gear 20 when the tractors 4 are positioned closed. The transmission gear 20 serves to transmit the drive of a driving source (not shown) to the drive gear 19.

A support plate 21 is bridged on the driven and support shafts 2 and 3 in the vicinity of the drive gear 19 and it extends beyond the driven shaft 2. A guide pin 22 and an engaging pin 23 are projected toward the drive gear 19 from the support plate 21 between the driven shaft 2 and the support shaft 3 and at an end thereof positioned on the side of the driven shaft 2. A plate-like stopper member 24 is provided with a slot 25 at the base portion thereof and the support shaft 3 is inserted into the slot 25 of the stopper member 24 in such a way that the support shaft 3 can move in the diameter direction thereof. The stopper member 24 is further provided with another slot 26 at the front end portion thereof and the guide pin 22 is inserted into the slot 26. The stopper member 24 can move therefore along its slots 25 and 26 in the diameter direction of the support shaft 3. The stopper member 24 is also provided with engaging teeth 27 on its end which faces the drive gear 19 and these engaging teeth 27 are engaged with the drive gear 19 only when the stopper member 24 is moved along its slots 25 and 26 in the direction of its approaching the drive gear 19.

The stopper member 24 has engaging faces 30 and 31 on rims 28 and 29 thereof and these engaging faces 30 and 31 are slanted relative to the moving direction of the stopper member 24 which moves in the diameter direction of the support shaft 3. A drive pin 32 is positioned at the back of and above the support shaft 3 and supported by both side plates (not shown) of the printer in such a way that it can be contacted with the engaging face 30 to move the stopper member 24 in the direction of the driven shaft 2 so as to engage the engaging teeth 27 with the drive gear 19 when the tractors 4 are positioned open and the stopper member 24 is positioned as shown by a broken line in FIG. 2(A). Another drive pin 33 is positioned between the driven shaft 2 and the support shaft 3 and a little below the level of these shafts and also supported, similarly to the drive pin 32, by both side plates of the printer in such a way that it can be contacted with the engaging face 31 to move the stopper member 24 in the direction of the support shaft 3 so as to release the engaging teeth 27 from the drive gear 19, when the tractors are positioned closed and the stopper member 24 is positioned as shown by a solid line in FIG. 2(A).

A lever 34 which can be swung by the stopper member 24 is positioned near the engaging pin 23 and it is provided with a hook 35 which is engaged with the engaging pin 23, when the tractors 4 are positioned closed, to prevent the tractors 4 from being swung open. It is urged by a coil spring 36 in such a direction that the hook 35 is engaged with the engaging pin. A cover 37 is projected from the foremost end of the stopper member 24 to cover the upper portion of the drive gear 19 when the tractors 4 are in their closed position.

When the driven shaft 2 is swung round the support shaft 3 to move the tractors 4 from their closed position shown by the solid line in FIG. 2(A) to their open position shown by the broken line in FIG. 2(B) so as to allow the paper S to be mounted on the tractors 4, the stopper member 24 whose teeth 27 have been released from the drive gear 19 by the drive pin 33 slidably contacted with its engaging face 31 is moved upward by the drive pin 32 slidably contacted with its engaging face 30 to engage its teeth 27 with the drive gear 19. The stopper member 24 cannot swing independently round the support shaft 3 because the guide pin 22 projected from the support plate 21 is inserted into the slot 26 of the stopper member 24. The rotation of the drive gear 19 which is engaged with the teeth 27 of the stopper member 24 can be thus prevented. As the result, the rotation of the drive pulley 5 which is connected to the drive gear 19 through the driven shaft 2 can also be prevented, thereby allowing the belts 7 not to run and the holes P on both sides of the paper S to be stably fitted onto the pins 8 on the belts 7.

When the paper S is held like this under the tractors 4, the tractors 4 are returned from their open state shown by the broken line in FIG. 2(A) to their close state shown by the solid line in FIG. 2(A) and the paper S is further to be mounted on the top of the tractors 4. Although the teeth 27 of the stopper member 24 are released from the drive gear 19 by the drive pin 33 contacted with the engaging face 31 of the stopper member 24 when the tractors 4 ar under their closed state shown by the solid line in FIG. 2(A), the drive gear 19 is engaged with the transmission gear 20. The rotation of the drive gear 19 can be thus prevented by the detent force of the drive source when the drive source is left inoperative, thereby enabling the holes P on both sides of the paper S to be stably fitted onto the pins 8 on the belts 7 at the top of the tractors 4.

According to the above-described embodiment of the present invention, the rotation of the drive gear 19 can be prevented at the time when the paper S is to be mounted on the tractors 4. In addition, the running of the belts 7 can also be prevented at the same time. Therefore, the holes P on both sides of the paper S can be stably fitted onto the pins 8 on the belts 7.

When a coil spring 38 shown by a dot-and-dash dash line in FIG. 2(A) is attached to the stopper member 24 at one end thereof and to a fixed member (not shown) at the other end thereof, the stopper member 24 can be urged in such directions that its teeth 27 are released from the drive gear 19 and engaged with the drive gear 19, depending upon whether the tractors 4 are under their open or closed state. Therefore, same effect as attained by the above-described embodiment can also be achieved without using the drive pins 32 and 33 in this case. It should also be understood that the present invention is not limited to these embodiments but various changes and modifications can be made without departing from the scope and spirit of the present invention.

According to the present invention as described above, the free running of the belts can be prevented at the time when the paper is mounted on the tractors, thereby making the mounting of the paper on the tractors easy and stable.

I claim:

1. A paper feeding mechanism for a printer comprising:

a driven shaft and a support shaft in parallel therewith;

a pair of tractors spaced apart from each other on opposite sides of a paper feeding path and supported in common on said driven shaft and said support shaft, said tractors having respective belts which are driven by said driven shaft for conveying a sheet of paper placed in engagement with said belts, said tractors being swingable on said driven shaft about said support shaft between an open position at which a paper to be conveyed is loaded in engagement with said belts of said tractors, and a closed position at which said tractors are driven to convey the paper by rotation of said driven shaft;

a drive gear for rotating said driven shaft mounted on said driven shaft and swingable therewith between said open and closed positions, by which said drive gear is moved out of and into engagement with a driving transmission gear, respectively;

a stopper member having teeth which are engageable with said drive gear to stop it from rotation at said open position; and a drive member for shifting said stopper member to engage its teeth with said drive gear only when said tractors are swung to said open position.

2. A paper feeding mechanism according to claim 1 wherein said stopper member is supported by the support shaft in such a way that it can move toward said driven shaft along a diameter direction of said support shaft.

3. A paper feeding mechanism according to claim 2 wherein said drive member includes a drive pin engageable with the stopper member when the tractors are at their open position, and an engaging face of the stopper member engaged with the drive pin to move the stopper member in the diameter direction of the support shaft.

4. A paper feeding mechanism according to claim 2 wherein said drive member includes a spring for switching the movement in the diameter direction of the urged stopper member, depending upon whether the tractors are under their open or close state.

* * * * *